US006284060B1

(12) United States Patent
Matsutani et al.

(10) Patent No.: US 6,284,060 B1
(45) **Date of Patent: *Sep. 4, 2001**

(54) MAGNETIC CORE AND METHOD OF MANUFACTURING THE SAME

(75) Inventors: Nobuya Matsutani, Katano; Yuji Mido, Higashiosaka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/148,116

(22) Filed: Sep. 4, 1998

Related U.S. Application Data

(63) Continuation-in-part of application No. 09/061,291, filed on Apr. 17, 1998, now Pat. No. 6,063,209.

(30) Foreign Application Priority Data

| | | |
|---|---|---|
| Apr. 18, 1997 | (JP) | 9-101415 |
| Apr. 24, 1997 | (JP) | 9-107009 |
| Dec. 17, 1997 | (JP) | 9-347470 |

(51) Int. Cl.[7] ..... H01F 1/22

(52) U.S. Cl. ..... 148/300; 148/307; 148/310; 252/62.54; 252/62.55; 75/230

(58) Field of Search ..... 252/62.54, 62.55; 148/300, 307, 310, 301, 302, 303, 304, 306; 75/230, 228, 246

(56) References Cited

U.S. PATENT DOCUMENTS

| | | | | |
|---|---|---|---|---|
| 4,601,753 | | 7/1986 | Soileau et al. . | |
| 4,601,765 | | 7/1986 | Soileau et al. . | |
| 5,002,677 | * | 3/1991 | Srall et al. | 252/62.54 |
| 5,198,138 | * | 3/1993 | Yamamoto et al. | 252/62.54 |
| 5,595,609 | * | 1/1997 | Gay | 148/104 |
| 5,643,491 | * | 7/1997 | Honkura et al. | 252/62.54 |
| 5,651,841 | * | 7/1997 | Moro et al. | 148/309 |
| 5,716,462 | * | 2/1998 | Sakurada et al. | 148/302 |
| 6,063,209 | * | 5/2000 | Matsutani et al. | 148/300 |

FOREIGN PATENT DOCUMENTS

| | | |
|---|---|---|
| 0112577 | 12/1983 | (EP) . |
| 2545640 | 5/1984 | (FR) . |
| 1-215902 | 8/1989 | (JP) . |
| 06291114 | 10/1994 | (JP) . |
| 06342714 | 12/1994 | (JP) . |
| 08045724 | 2/1996 | (JP) . |

* cited by examiner

*Primary Examiner*—John P. Sheehan
(74) *Attorney, Agent, or Firm*—McDermott, Will & Emery

(57) ABSTRACT

A magnetic core of a compressed compact comprises a mixture of magnetic powder and a spacing material, wherein the distance between adjacent magnetic powder particles is controlled by the spacing material. In this constitution, a magnetic core low in core loss, high in magnetic permeability, and excellent in direct-current superposing characteristic is realized.

6 Claims, 1 Drawing Sheet

MAGNETIC CORE AND METHOD OF MANUFACTURING THE SAME

CROSS-REFERENCE TO RELATED APPLICATIONS

This application is a Continuation-In-Part of U.S. Pat. No. 6,063,209 issued May 16, 2000, U.S. Ser. No. 09/061,291 filed on Apr. 17, 1998.

TECHNICAL FIELD

The present invention relates to a magnetic core made of a composite magnetic material with high performance used in a choke coil or the like, and more particularly to a magnetic core made of a metallic soft magnetic material and its manufacturing method.

BACKGROUND ART

Recently, downsizing of electric and electronic appliances is advanced, and magnetic cores of small size and high performance are demanded. In a choke coil used at high frequency, a ferrite core and a dust core are used. Of them, the ferrite core is noted for its defect of small saturation magnetic flux density. By contrast, the dust core fabricated by forming metal magnetic powder has an extremely large saturation magnetic flux density as compared with the soft magnetic ferrite, and it is therefore advantageous for downsizing. However, the dust core is not superior to the ferrite in magnetic permeability and electric power loss. Accordingly, when the dust core is used in the choke coil or inductor core, the core loss is large, and hence the core temperature rise is large, so that it is hard to reduce the size of the choke coil.

The core loss consists of eddy current loss and hysteresis loss. The eddy current loss increases in proportion to the square of frequency and the square of a flowing size of eddy current. Therefore, in the dust core used in the coil, to suppress generation of eddy current, the surface of the magnetic powder is covered with an electric insulating resin. However, in order to increase the saturation magnetic flux density, the dust core is formed usually by applying a forming pressure of 5 tons/cm$^2$ or more. As a result, the distortion applied to the magnetic material is increased, and the magnetic permeability deteriorates, while the hysteresis loss increases. To avoid this, after forming, heat treatment is carried out as required to remove the distortion.

The dust core requires an insulating binder in order to keep electric insulation among magnetic powder particles and to maintain binding among magnetic powder particles. As the binder, an insulating resin or an inorganic binder is used. The insulating resin includes, among others, epoxy resin, phenol resin, vinyl chloride resin, and other organic resins. These organic resins, however, cannot be used where high temperature heat treatment is required for removal of distortion because they are pyrolyzed during heat treatment.

Conventionally, various inorganic binders have been proposed, including silica water glass, alumina cement disclosed in Japanese Laid-open Patent No. 1-215902, polysiloxane resin disclosed in Japanese Laid-open Patent No. 6-299114, silicone resin disclosed in Japanese Laid-open Patent No. 6-342714, and a mixture of silicone resin and organic titanium disclosed in Japanese Laid-open Patent No. 8-45724.

In the conventional ferrite core, in order to suppress the decline of the inductance L value in direct-current superposing and to assure the direct-current superposing characteristic, a gap of several hundred microns is provided in a direction vertical to the magnetic path. Such wide gap, however, may be a source of beat sound, or when used in a high frequency band, in particular, the leakage flux generated in the gap may extremely increase the copper loss in the winding. On the other hand, the dust core is low in magnetic permeability and is hence used without gap, and therefore it is small in beat sound and copper loss due to leakage flux.

In the core having a gap, the inductance L value declines suddenly from a certain point in the direct-current superposing current. In the dust core, by contrast, it declines smoothly along with the direct-current superposing current. This is considered because of the presence of the distribution width in the magnetic space existing inside the dust core. That is, at the time of press forming, a distribution width is formed in the distance among magnetic powder particles isolated by a binder such as resin and in the magnetic space length. The magnetic flux begins to short-circuit and saturate from the position of shorter magnetic space length or from the closely contacting position of magnetic powder particles, which is considered to cause such direct-current superposing characteristics. Therefore, in order to assure an excellent direct-current superposing characteristic securely, by increasing the amount of the binder, it is necessary to keep a magnetic space in a size more than the required minimum limit. However, when the content of the binder is increased, the magnetic permeability of the entire core is lowered. Besides, if the core loss is large in the high frequency band, although the apparent direct-current superposing characteristic is excellent, it is only that the apparent magnetic permeability is increased when the core loss is larger. It is hence difficult to satisfy the contradictory properties of small core loss and excellent direct-current superposing characteristic at the same time.

SUMMARY OF THE INVENTION

The present invention solves the above problems, and it is an object thereof to provide a magnetic core small in core loss, high in magnetic permeability, and having an excellent direct-current superposing characteristic.

A magnetic core of the present invention is a compressed compact comprising a mixture of magnetic powder and spacing material, and is characterized by control of distance $\delta$ between adjacent magnetic powder particles by the spacing material. By using the spacing material, a space length of a required minimum limit is assured between adjacent magnetic powder particles, and the magnetic space distribution width is narrowed on the whole. Therefore, while maintaining the high magnetic permeability, an excellent direct-current superposing characteristic is realized. Moreover, since the magnetic powder is securely isolated, the eddy current loss is decreased.

DESCRIPTION OF THE PREFERRED EMBODIMENTS

Figure 1:
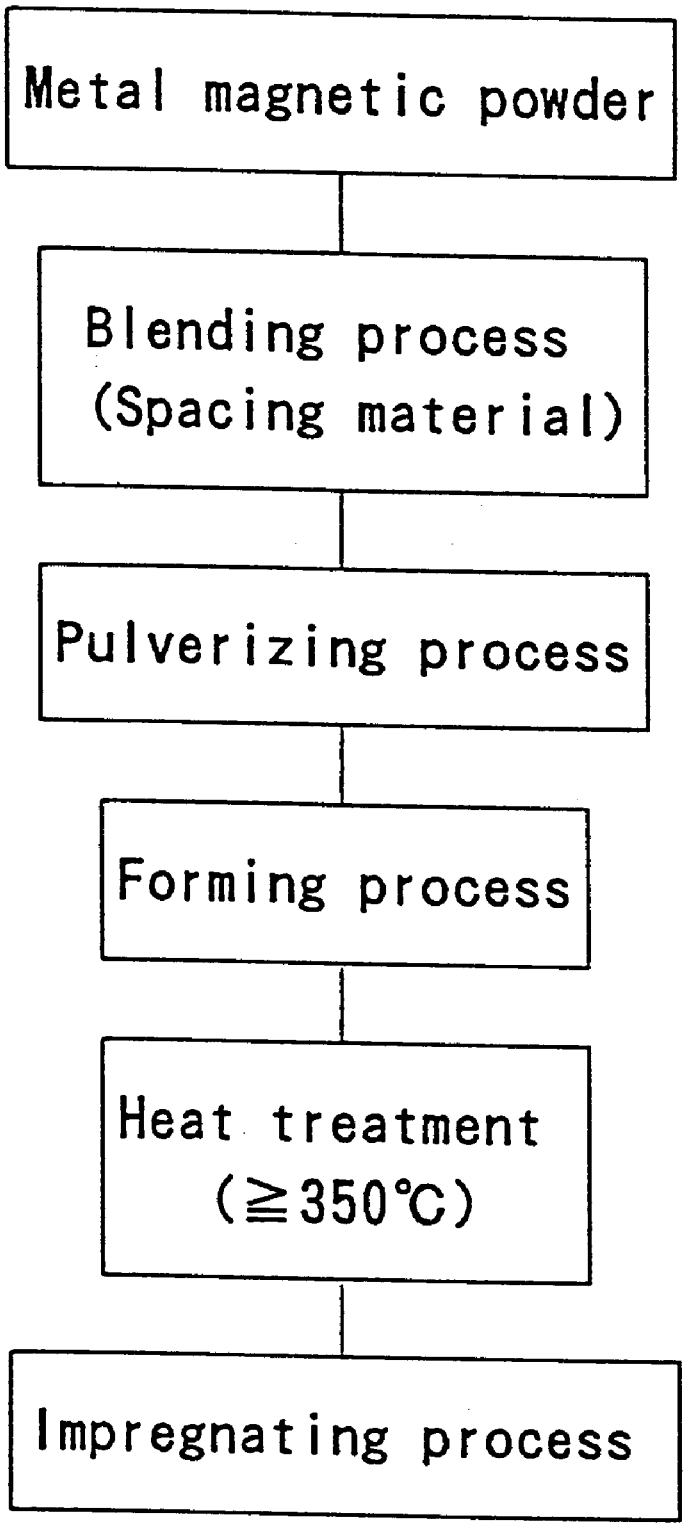
FIG. 1 is a flowchart for explaining a method of manufacturing a magnetic core of the present invention.

A magnetic core of the present invention is composed of a compressed compact comprising a mixture of magnetic powder and spacing material, of which distance $\delta$ between adjacent magnetic powder particles is controlled by the spacing material.

In the magnetic core, if the spacing material is also made of a magnetic material, the magnetic permeability of the magnetic powder is preferred to be larger than the magnetic permeability of the spacing material.

Supposing the distance between adjacent magnetic powder particles to be δ and the mean particle size of magnetic powder to be d, it is preferred that the relation expressed in the formula $10^{-3} \leqq \delta/d \leqq 10^{-1}$ be satisfied in 70% or more of the entire magnetic powder.

The magnetic power is preferred to be powder of a magnetic material containing at least one of the ferromagnetic materials selected from the group consisting. of pure iron, Fe—Si alloy, Fe—Al—Si alloy, Fe—Ni alloy, permendur, amorphous alloy, and nano-order micro-crystal alloy. These magnetic powders are high in both saturation magnetic flux density and magnetic permeability, and high characteristics are obtained in various manufacturing methods such as atomizing method, pulverizing method and super-quenching method.

The mean particle size of magnetic powder is preferred to be 1–100 microns.

The spacing material preferably contains at least one of the inorganic matters selected from the group consisting of $Al_2O_3$, MgO, $TiO_2$, ZrO, $SiO_2$ and CaO. Powders of these inorganic matters are less likely to react with the magnetic powder in heat treatment. As the spacing material, a composite oxide or nitride may be also used. When an inorganic matter powder is used in the spacing material, the mean particle size of this inorganic matter powder is preferred to be 0.01–10 microns.

It is also preferred to use an organic matter powder in the spacing material. In particular, it is preferred to use one of silicone resins, fluorocarbon resins, benzoguanamine resins and the following organic compound C.

It is further preferred to use a metal powder in the spacing material. In particular, a metal powder with mean particle size of 0.1–20 microns is preferred.

It is moreover preferred to use a mixture of at least two types out of the following materials (a), (b) and (c) in the spacing material. That is, (a) is at least one inorganic matter selected from the group consisting of $Al_2O_3$, MgO, $TiO_2$, ZrO, $SiO_2$ and CaO, (b) is at least one organic matter selected from the group consisting of silicone resins, fluorocarbon resins, benzoguanamine resins and the following organic compound C, and (c) is a metal powder.

It is preferred to impregnate an insulating impregnating agent in a magnetic core composed of a compressed compact comprising a mixture of magnetic powder and a spacing material. In particular, it is more preferable to impregnate an insulating impregnating agent in a compressed compact of which porosity is in a range of 5 to 50 vol. %.

A method of manufacturing a magnetic core of the present invention is characterized by controlling the distance δ between adjacent magnetic powder particles by the spacing material by heat treatment at a temperature of 350–900° C. after compression forming of a mixture of magnetic powder and a spacing material.

In the manufacturing method, as the spacing material, it is preferred to use a metal powder having a melting point higher than the temperature in the heat treatment process. The heat treatment temperature is preferred to be 350° C. or higher. In particular, it is preferred to be 600° C. or higher when using Fe—Al—Si alloy, or 700° C. or higher when using pure iron. When using amorphous alloy and nano-order microcrystal alloy, on the other hand, since they are crystallized at a high temperature, the heat treatment temperature is preferred to be 350° C. or higher and 600° C. or lower. The heat treatment process is preferred to be conducted in a non-oxidizing atmosphere.

Specific embodiments of the invention are described below.

Embodiment 1

A magnetic core in embodiment 1 of the present invention is described below while referring to FIG. 1.

First, powders as shown in Table 1 were prepared as the magnetic powder. These powders are pure iron powder with purity of 99.6%, Fe—Al—Si alloy powder in sendust composition of 9% of Si, 5% of Al and remainder of Fe, Fe—Si alloy powder of 3.5% of Si and remainder of Fe, Fe—Ni alloy powder of 78.5% of Ni and remainder of Fe, and permendur powder of 50% of Co and remainder of Fe. These metal magnetic powders are fabricated by atomizing method, and are 1–100 microns (preferably 60–80 microns) in mean particle size.

The Fe-base amorphous alloy magnetic powder is Fe—Si—B alloy powder, and the nano-order microcrystal magnetic powder is Fe—Si—B—Cu alloy powder. These powders are obtained by fabricating ribbons by liquid quenching method and then crushing the ribbons, and the mean particle size is 1–100 microns (preferably 60–80 microns) in both. The spacing material shown in Table 1 is inorganic matter powder with particle size of 3–5 microns.

To 100 parts by weight of metal magnetic powder, 1 part by weight of spacing material, 3 parts by weight of butyral resin as a binder, and 1 part by weight of ethanol as solvent for dissolving the binder were added, and they were mixed by using a mixing agitator. Incidentally, when using a metal powder of highly oxidizing property, the mixing process was conducted in a non-oxidizing atmosphere of nitrogen or the like.

After the mixing process, the solvent was removed from the mixture and it was dried. The dried mixture was crushed, and pulverized to keep a fluidity to be applicable to a molding machine.

The prepared pulverized powder was put in a die, and pressurized and molded by a uniaxial press at a pressure of $10t/cm^2$ for three seconds . As a result, a toroidal formed piece of 25 mm in outside diameter, 15 mm in inside diameter, and about 10 mm in thickness was obtained.

The obtained formed piece was put in a heat treatment oven, and heated in nitrogen atmosphere at heat treatment temperature shown in Table 1. The holding time of the heat treatment temperature was 0.5 hours.

By the manufacturing method described herein, samples shown in Table 1 were prepared. Sample numbers 1 to 18 are embodiments of the present invention, and sample numbers 19 to 23 are comparative examples. In these samples, the magnetic permeability, core loss, and direct-current superposing characteristic were measured. The magnetic permeability was measured by using an LCR meter at frequency of 10 kHz, and the core loss by alternating-current B-H curve measuring instrument at measuring frequency of 50 kHz, and measuring magnetic flux density of 0.1 T. The direct-current superposing characteristic shows the changing rate of L value at the measuring frequency of 50 kHz and direct-current magnetic field of 1600 A/m.

Results of these measurements are shown in Table 1.

TABLE 1

| | Sample No. | Metal magnetic powder | Spacing material | Heating temperature (° C.) | Permeability | Core loss (kW/m$^3$) | DC superposing (%) |
|---|---|---|---|---|---|---|---|
| Embodiment | 1 | Fe—Al—Si | $SiO_2$ | 750 | 91 | 721 | 88 |
| | 2 | Pure iron | | | 82 | 622 | 92 |
| | 3 | Fe—Si | | | 131 | 865 | 86 |
| | 4 | Fe—Ni | | | 153 | 733 | 75 |
| | 5 | Parmendur | | | 68 | 798 | 83 |
| | 6 | Fe—Al—Si | $Al_2O_3$ | | 92 | 706 | 85 |
| | 7 | Fe—Al—Si | MgO | | 88 | 622 | 83 |
| | 8 | Fe—Al—Si | $TiO_2$ | | 89 | 797 | 88 |
| | 9 | Fe—Al—Si | ZrO | | 96 | 700 | 84 |
| | 10 | Fe—Al—Si | CaO | | 94 | 811 | 85 |
| | 11 | Fe—Ni | $TiO_2$ | 650 | 90 | 776 | 91 |
| | 12 | Fe—Si | | 500 | 95 | 803 | 88 |
| | 13 | Fe—Si | | 700 | 144 | 621 | 84 |
| | 14 | Fe—Si | | 900 | 153 | 623 | 78 |
| | 15 | Amorphous | | 350 | 106 | 643 | 85 |
| | 16 | Amorphous | | 500 | 110 | 699 | 84 |
| | 17 | Nano-order microcrystal | | None | 81 | 805 | 73 |
| | 18 | Nano-order microcrystal | | 350 | 99 | 476 | 88 |
| Comparison | 19 | Fe—Al—Si | None | 750 | 96 | 1260 | 60 |
| | 20 | Fe—Si | $TiO_2$ | None | 22 | 1905 | 91 |
| | 21 | Fe—Si | | 300 | 36 | 1520 | 91 |
| | 22 | Amorphous | | 300 | 40 | 1350 | 90 |
| | 23 | Fe—Si | | 950 | 213 | 1830 | 67 |

The selection standard in the choke coil for countermeasure against harmonic distortion is the core loss of 1000 kW/m$^3$ or less, magnetic permeability of 40 or more, and direct-current superposition of 70% or more in the condition of the current measuring frequency of 50 kHz and measuring magnetic flux density of 0.1 T.

The ratio of the distance 6 of adjacent magnetic powder particles and to mean particle size d of magnetic powder, $\delta/d$, was measured by using a secondary ion mass spectrometer (SIMS) and electron probe X-ray microanalyzer (EPMA). As a result, in the sample of sample number 19, the measured value of $\delta/d$ was smaller than $10^{-3}$, but in the samples of sample numbers 1 to 18, the relation of $10^{-3} \leqq \delta/d \leqq 10^{-1}$ was satisfied in more than 70% of the magnetic powder of the entire magnetic powder.

As clear from the results in Table 1, the samples of sample numbers 1 to 18 using any one of pure iron, Fe—Si, Fe—Al—Si, Fe—Ni, permendur, amorphous alloy, and nano-order microcrystal alloy as the magnetic powder, and any inorganic matter of $Al_2O_3$, MgO, $TiO_2$, ZrO, $SiO_2$ and CaO as the spacing material satisfy the above selection standard, and are excellent in magnetic permeability, core loss, and direct-current superposing characteristic.

Meanwhile, when heated at a temperature of 350–900° C., as compared with the heat treatment at 300° C., all of magnetic permeability, core loss and direct-current superposing characteristic were superior. Incidentally, in certain magnetic powders, the characteristics can be maintained without heat treatment after compression molding, but it is preferred to heat at temperature of 350° C. or more in order to further enhance the characteristics.

Embodiment 2

The metal magnetic powders and spacing materials shown in Table 2 were prepared, and samples of sample numbers 24 to 30 were fabricated in the same manufacturing method and manufacturing conditions as in embodiment 1 except that the heat treatment pure was 720° C.

These samples were evaluated same as in embodiment 1. Results of evaluation are shown in Table 2.

TABLE 2

| | | Metal magnetic powder | | Spacing material | | | | |
|---|---|---|---|---|---|---|---|---|
| | Sample No. | Composition | Particle size (μm) | Composition | Particle size (μm) | Permeability | Core loss (kW/m$^3$) | DC superposing (%) |
| Embodiment | 24 | Pure iron | 100 | $Al_2O_3$ | 2 | 105 | 878 | 81 |
| | 25 | Pure iron | 50 | | | 87 | 491 | 86 |
| | 26 | Pure iron | 10 | | | 76 | 224 | 88 |
| | 27 | Pure iron | 1 | | | 70 | 184 | 90 |
| | 28 | Fe—Al—Si | 100 | $TiO_2$ | 10 | 74 | 532 | 90 |
| | 29 | Fe—Al—Si | | | 1 | 113 | 613 | 85 |
| | 30 | Fe—Al—Si | | | 0.01 | 143 | 727 | 82 |

TABLE 2-continued

| | Sample No. | Metal magnetic powder: Composition | Metal magnetic powder: Particle size (μm) | Spacing material: Composition | Spacing material: Particle size (μm) | Permeability | Core loss (kW/m³) | DC superposing (%) |
|---|---|---|---|---|---|---|---|---|
| Comparison | 31 | Pure iron | 120 | $Al_2O_3$ | 2 | 124 | 1254 | 86 |
| | 32 | Pure iron | 0.5 | | | 28 | 2189 | 94 |
| | 33 | Fe—Al—Si | 100 | $TiO_2$ | 12 | 34 | 524 | 92 |
| | 34 | Fe—Al—Si | 100 | | 0.005 | 184 | 3101 | 76 |

As clear from the results in Table 2, samples (numbers 24 to 30) with the mean particle size of magnetic powder of 1–100 microns the selection standard of choke coil mentioned in embodiment 1. The samples of which mean particle size of spacing material was 0.01–10 microns also satisfied the selection standard.

As clear from comparison of sample numbers 24 to 26, the magnetic permeability and core loss characteristics are superior in the samples (numbers 25, 26) of 50 microns or less in the mean particle size of magnetic powder to the sample (number 24) of 100 microns. The same is said of the eddy current loss. This is considered because the eddy current depends on the particle size of the metal magnetic powder, and the eddy current loss decreases when the size is smaller. The mean particle size of magnetic powder is preferable in 1–100 microns, more preferable in 1–50 microns. Eddy current loss increases in magnetic particle size of more than 100 microns, and magnetic permeability decreases in magnetic particle size of less than 1 microns because the density of the core becomes small. Further, by covering the surface of magnetic powder with an insulating material, the eddy current loss decreases. In this embodiment, when an oxide film of 5 nm or more is formed on the surface of the metal magnetic powder, the insulation is further increased and it is known that the eddy current loss is decreased.

In this embodiment, although the magnetic powder particle adjacent distance δ is controlled by the spacing material, it is possible that the spacing material be crushed when compression forming if the particle size of the spacing material is too large. For example, if the mean particle size of the spacing material exceeds 10 microns, if crushed to be fine by compressing and forming, the fluctuations of particle size are large, and the distribution width of the magnetic space δ is increased. Therefore, the mean particle size of the spacing material is preferred to be 10 microns or less. When mean particle size of the spacing material is smaller than 0.01 microns, particles of the magnetic powder contact one another, and eddy current loss increases.

Embodiment 3

As the metal magnetic powder, Fe—Al—Si alloy atomized powder (mean particle size 80 microns) in sendust composition of 9% of Si, 5% of Al, and remainder of Fe was prepared. As the spacing material, as shown in Table 3, four organic matters (mean particle size 1–3 microns) were prepared, that is, silicone resin powder, fluorocarbon resin powder, benzoguanamine resin powder, and organic compound C shown in the following formula.

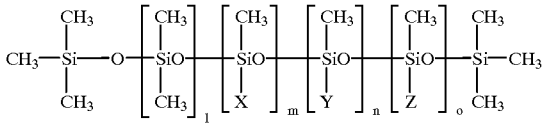

where X is an alkoxy silyl group, Y is an organic functional group, and Z is an organic unit, and each of l, m, n and o shows a number of respective group shown by the bracket which is an integer not less than zero.

Samples of sample numbers 35 to 39 were prepared in the same method and conditions as in embodiment 1, except that the binder used in the mixing process was added by 1 part by weight and that the heat treatment temperature was 750° C.

These samples were evaluated same as in embodiment 1. Results of evaluation are shown in Table 3. In sample number 39, the measurement of δ/d was smaller than $10^{-3}$, but in other samples, the relation of $10^{-3} \leqq \delta/d \leqq 10^{-1}$ was satisfied in more than 70% of the magnetic powder of the entire magnetic powder.

TABLE 3

| | Sample No. | Spacing material | Permeability | Core loss (kW/m³) | DC superposing (%) |
|---|---|---|---|---|---|
| Embodiment | 35 | Silicone resin powder | 88 | 396 | 87 |
| | 36 | Fluorocarbon resin powder | 96 | 511 | 91 |
| | 37 | Benzoguanamine resin powder | 90 | 455 | 85 |
| | 38 | Organic compound C | 111 | 370 | 89 |
| Comparison | 39 | None | 96 | 1260 | 60 |

As clear from the results in Table 3, by using the above organic matter as the spacing material, the adjacent distance δ of magnetic powder particles is controlled, and excellent magnetic permeability, core loss and direct-current superposing characteristics are obtained. To obtain further excellent characteristics, it is preferred to use the organic matter of a smaller particle size. Moreover, since the organic matter powder is likely to be deformed when compressing and forming, and magnetic powder particles adhere strongly with each other, so that the strength of the compressed compact is high.

Organic matter powders used as the spacing material in the embodiment are all high in heat resistance, and the effect as the spacing material can be maintained even after heat treatment process, and therefore the spacing material is preferable. Aside from these organic matter powders, others high in heat resistance can be also used.

The organic compound C, aside from the above effects, has the effect of lowering the elasticity of the binder for enhancing the powder forming property, and the effect of suppressing the spring-back of the formed material after powder forming. In particular, the molecular weight of the organic compound C is preferred to be tens of thousands or less, or more preferably the molecular weight should be about 5000. Still more, if same as the organic compound C in the basic composition, an organic compound changed in the end functional group may be also used.

The content of the organic matter as the spacing material is preferred to be 0.1 to 5.0 parts by weight in 100 parts by weight of the magnetic powder. If the organic compound is less than 0.1 part by weight, the efficacy as the spacing material is poor, or if more than 5 parts by weight, the filling rate of the magnetic powder is lowered and hence the magnetic characteristic declines.

Embodiment 4

Sample numbers 40 to 44 shown in Table 4 were prepared in the same method and conditions as in embodiment 3, except that the spacing material was the organic compound C and that the forming pressure was adjusted to vary δ/d.

These samples were evaluated same as in embodiment 1. Results of evaluation are shown in Table 4.

TABLE 4

| | Sample No. | δ/d | Permeability | Core loss (kW/m$^3$) | DC superposing (%) |
|---|---|---|---|---|---|
| Embodiment | 40 | $10^{-3}$ | 110 | 620 | 85 |
| | 41 | $10^{-2}$ | 100 | 370 | 89 |
| | 42 | $10^{-1}$ | 80 | 400 | 93 |
| Comparison | 43 | $10^{0}$ | 30 | 750 | 80 |
| | 44 | $10^{-4}$ | 120 | 980 | 63 |

As clear from the results in Table 4, to suffice both excellent direct-current superposing characteristic and magnetic permeability, it is required to satisfy the relation of $10^{-3} \leqq \delta/d \leqq 10^{-1}$, and the samples of numbers 40 to 42 conform to this relation. Besides, the other characteristics are also excellent.

This relation is explained herein. Generally, supposing the true magnetic permeability of magnetic powder to be $\mu r$ and the effective magnetic permeability of magnetic core to be $\mu e$, the following relation is known.

$$\mu e \neq \mu r/(1+\mu r \cdot \delta/d)$$

The lower limit of δ/d is determined by the minimum required limit of the direct-current superposing characteristic, while the upper limit of δ/d is determined by the required magnetic permeability. To realize satisfactory characteristics, it is required that the relation of $10^{-3} \leqq \delta/d \leqq 10^{-1}$ be satisfied in more than 70% of magnetic powder in the entire magnetic powder, and more preferably the relation should be $10^{-3} \leqq \delta/d \leqq 10^{-2}$.

Embodiment 5

Sample numbers 45 to 51 as shown in Table 5 were prepared in the same method and conditions as in embodiment 1, except that the spacing material was Ti and Si with mean particle size of 5–10 microns, and that the heat treatment temperature was 750° C.

These samples were evaluated same as in embodiment 1. Results of evaluation are shown in Table 5.

TABLE 5

| | Sample No. | Metal magnetic powder | Spacing material | Permeability | Core loss (kW/m$^3$) | DC superposing (%) |
|---|---|---|---|---|---|---|
| Embodiment | 45 | Fe—Al—Si | Ti | 89 | 722 | 88 |
| | 46 | Pure iron | | 78 | 607 | 91 |
| | 47 | Fe—Si | | 126 | 867 | 84 |
| | 48 | Fe—Ni | | 153 | 726 | 77 |
| | 49 | Permendur | | 70 | 808 | 85 |
| | 50 | Fe—Al—Si | Si | 91 | 713 | 89 |
| Comparison | 51 | Fe—Al—Si | None | 96 | 1260 | 60 |

In sample number 51, the measured value of δ/d was smaller than $10^{-3}$, but in other samples, the relation of $10^{-3} \leqq \delta/d \leqq 10^{-1}$ was satisfied in more than 70% of the entire magnetic powder.

As clear from the results in Table 5, by using any one of pure iron, Fe—Si alloy, Fe—Al—Si alloy, Fe—Ni alloy and permendur as magnetic powder, and using metal Ti or Si as spacing material, the characteristics satisfying the selection standard of choke coil are obtained. Thus, Ti and Si are preferred materials as the spacing material. Metal materials other than the above spacing materials may be also used as far as they are less likely to react with the magnetic powder during heat treatment. Examples include metals such as Al, Fe, Mg and Zr. In addition, the metal as the effect of deforming easily in compression forming to bind magnetic powder particles together, and also the effect of enhancing the strength of the compressed compact.

Embodiment 6

Sample numbers 52 to 54 were prepared in the same method and conditions as in embodiment 5, except that the metal magnetic powder was Fe—Al—Si alloy atomized powder in sendust composition (mean particle size 80 microns), that the spacing material was Al, that the forming pressure was 8 t/cm$^2$, and that the heat treatment temperature was changed as shown in Table 6.

These samples were evaluated same as in embodiment 1. Results of evaluation are shown in Table 6.

TABLE 6

| | Sample No. | Heating temperature (° C.) | Permeability | Core loss (kW/m$^3$) | DC superposing (%) |
|---|---|---|---|---|---|
| Embodiment | 52 | 500 | 45 | 600 | 91 |
| | 53 | 600 | 65 | 550 | 91 |
| Comparison | 54 | 700 | 25 | 2000 | 97 |

As clear from the results in Table 6, when heated at a temperature over the melting point of 660° C. of Al, the metal was fused and the effect as spacing effect was lost. As a result, the characteristic deteriorated significantly. At a heat treatment temperature lower than the melting point, a favorable characteristic is shown. Thus, by using a metal powder of which melting point is higher than the heat treatment temperature as the spacing material, a favorable characteristic is obtained.

Embodiment 7

Sample numbers 55 to 60 were prepared in the same method and conditions as in embodiment 6, except that the spacing material was the Ti powder having various mean particle sizes, and that the heat treatment temperature was 750° C.

These samples were evaluated same as in embodiment 1. Results of evaluation are shown in Table 7.

TABLE 7

| | Sample No. | Mean particle size (μm) | Permeability | Core loss (kW/m³) | DC superposing (%) |
|---|---|---|---|---|---|
| Embodiment | 55 | 20 | 56 | 500 | 91 |
| | 56 | 10 | 74 | 530 | 90 |
| | 57 | 1 | 110 | 610 | 85 |
| | 58 | 0.1 | 142 | 829 | 82 |
| Comparison | 59 | 25 | 34 | 520 | 92 |
| | 60 | 0.05 | 184 | 3672 | 71 |

As clear from the results in Table 7, in the case of this embodiment, as the mean particle size of the spacing material was smaller, the magnetic permeability increased, and a very favorable characteristic was obtained in particular at 0.1–20 microns. When mean particle size was smaller than 0.1 microns, eddy current loss increased.

Embodiment 8

As the spacing material, $Al_2O_3$ with particle size of 5 microns, Ti with particle size of 10 microns, silicone resin powder with particle size of 1 micron, and organic compound C were prepared, and they were combined by equivalent amounts as shown in Table 8, and the total amount of the combined spacing materials was blended by 1 part by weight to 100 parts by weight of magnetic powder. Sample numbers 61 to 67 were prepared in the same method and conditions as in embodiment 7, except that the forming pressure was 10 t/cm² and that the heat treatment temperature was 700° C.

These samples were evaluated same as in embodiment 1. Results of evaluation are shown in Table 8.

TABLE 8

| | Sample No. | Spacing material | Spacing material | Permeability | Core loss (kW/m³) | DC superposing (%) |
|---|---|---|---|---|---|---|
| Embodiment | 61 | $Al_2O_3$ | Ti | 86 | 603 | 92 |
| | 62 | | Silicone resin powder | 88 | 552 | 89 |
| | 63 | | Organic compound C | 110 | 728 | 84 |
| | 64 | Ti | Silicone resin powder | 90 | 666 | 83 |
| | 65 | | Organic | 96 | 543 | 87 |
| | 66 | Silicone resin Powder | Compound C | 102 | 501 | 84 |
| Comparison | 67 | None | None | 92 | 1188 | 60 |

In sample number 67, the measurement of δ/d was smaller tan $10^{-3}$, but in other samples, the relation of $10^{-3} \leqq \delta/d \leqq 10^{-1}$ was satisfied in more than 70% of the entire magnetic powder.

As clear from the results in Table 8, when the spacing materials were combined, the characteristics satisfying the selection standard of choke coil were obtained. In the embodiment, only two kinds were combined, but it is also effective to combine more kinds.

Embodiment 9

As shown in Table 9, the spacing material was Fe—Ni alloy powder (mean particle size 5 microns) composed of 78.5% of Ni and remainder of Fe, adjusted to the magnetic permeability of 1500, 1000, 900, 100, and 10 by varying the heat treatment condition. Sample numbers 68 to 72 were prepared in the same method and conditions as in embodiment 8, except that the forming pressure was 7t/cm². Herein, the magnetic permeability of the Fe—Al—Si alloy used as metal magnetic powder was 1000.

These samples were evaluated same as in embodiment 1. Results of evaluation are shown in Table 9.

TABLE 9

| | Sample No. | Permeability of spacing material | Permeability | Core loss (kW/m³) | DC superposing (%) |
|---|---|---|---|---|---|
| Embodiment | 68 | 900 | 160 | 766 | 75 |
| | 69 | 100 | 110 | 820 | 82 |
| | 70 | 10 | 90 | 750 | 84 |
| Comparison | 71 | 1000 | 165 | 760 | 65 |
| | 72 | 1500 | 188 | 763 | 63 |

As clear from the results in Table 9, when the magnetic permeability of spacing material was smaller than the magnetic permeability of metal magnetic powder, the characteristics satisfying the selection standard of choke coil were obtained. This is considered because the spacing material substantially becomes a magnetic space, and the distance δ between magnetic particle powders is changed, so that the magnetic permeability and direct-current superposing characteristic of the magnetic core can be controlled.

Embodiment 10

The metal magnetic powder was pulverized powder of Fe—Ni alloy (composition of 78.5% of Ni and remainder of Fe) with mean particle size of 70 microns and differing in particle size distribution, and the spacing material was Ti powder with mean particle size of 7 microns. Using the impregnating materials shown in Table 10, at heat treatment temperature of 680° C., sample numbers 73 to 79 were prepared in the same method and conditions as in embodiment 1, except that the porosity was changed by the forming pressure and particle size distribution of metal magnetic powder.

In these samples, same as in embodiment 1, the magnetic permeability and core loss were evaluated. Moreover, by three-point bending test method at head speed of 0.5 mm/min, the breakage strength was measured. Results of evaluation are summarized in Table 10.

TABLE 10

| | Sample No. | Porosity (%) | Impregnating agent | Permeability | Core loss ($kW/m^3$) | Breakage strength ($N/mm^2$) |
|---|---|---|---|---|---|---|
| Embodiment | 73 | 5 | Epoxy resin | 87 | 750 | 27 |
| | 74 | 10 | | 79 | 870 | 35 |
| | 75 | 50 | | 47 | 880 | 49 |
| | 76 | 10 | Silicone resin | 78 | 850 | 32 |
| Comparison | 77 | 3 | Epoxy resin | 98 | 620 | 12 |
| | 78 | 55 | | 34 | 950 | 52 |
| | 79 | 20 | None | 75 | 850 | ≦1 |

In the choke coil for measure against harmonic distortion, the breakage strength is desired to be 20 $N/mm^2$ or more, and as clear from the results in Table 10, sample numbers 73 to 76 and 78 satisfied this breakage strength. However, sample number 78 did not conform to the selection standard in magnetic permeability.

As known from Table 10, in the case of samples of which porosity after heat treatment was 5 vol. % to 50 vol. %, the mechanical strength was enhanced by impregnating with the insulating impregnating agent. There was no problem in the reliability test. Thus, by impregnating with the insulating impregnating agent, the core strength can be enhanced. Moreover, impregnation with insulating impregnating agent is effective for enhancement of rust prevention of metal magnetic powder and resistance of surface. As the method of impregnating, aside from the ordinary impregnation, vacuum impregnating or pressurized impregnating method may be effective. By these impregnating methods, since the impregnating agent can permeate deep inside of the core, these effects are further enhanced.

To enhance the impregnating effects, it is important that the porosity after heat treatment may be 5 vol. % or more and 50 vol. % or less of the total. When the porosity is 5 vol. % or more, the pores are open, and the impregnating agent can permeate deep inside of the core, and therefore the mechanical strength and reliability are enhanced. However, when the porosity exceeds 50 vol. %, it is not preferred because the magnetic characteristics deteriorate.

As the insulating impregnating agent, general resins may be used depending on the purpose of use, including epoxy resin, phenol resin, vinyl chloride resin, butyral resin, organic silicone resin, and inorganic silicone resin. The standard for selecting the material includes resistance to soldering heat, resistance to thermal impact such as heat cycle, and appropriate resistance value.

INDUSTRIAL APPLICABILITY

As described herein, the magnetic core of the present invention is a compressed compact comprising a mixture of magnetic powder and a spacing material, and is characterized by control of distance δ between adjacent magnetic powder particles by the spacing material. In this constitution, a magnetic core low in core loss, high in magnetic permeability, and excellent in direct-current superposing characteristic is realized, and the present invention has an extremely high industrial value.

What is claimed is:

1. A magnetic core comprising a mixture of magnetic powder and a spacing material, wherein the distance between adjacent particles of said magnetic powder is controlled by said spacing material and wherein the distance between adjacent magnetic particles is represented by δ and the mean particle size of magnetic powder is represented by d, and the relationship of $10^{-3} \leqq \delta/d \leqq 10^{-1}$ is satisfied in 70% or more of the magnetic powder, said magnetic powder comprising a soft magnetic material.

2. A magnetic core of claim 1, wherein the mean particle size of said magnetic powder is 1–100 microns.

3. A magnetic core of claim 1, wherein said spacing material is an inorganic matter with mean particle size of 0.01–10 microns.

4. A magnetic core of claim 1, wherein said spacing material is composed of an organic matter expressed in the formula:

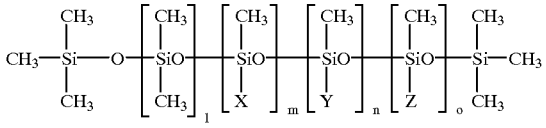

where X is an alkoxy silyl group, Y is an organic functional group, and Z is an organic unit, and each of l, m, n and o is an integer not less than zero.

5. A magnetic core of claim 1, wherein said spacing material is a metal powder with mean particle size of 0.1–20 microns.

6. The magnetic core of claim 1, wherein said spacing material is composed of at least two types out of (a) an inorganic matter powder, which is at least one inorganic matter selected from the group consisting of $Al_2O_3$, MgO, $TiO_2$, ZrO, $SiO_2$, and CaO, (b) an organic matter powder which is at least one organic matter selected from the group consisting of silicon resins, fluorocarbon resins, benzoguanamine resins and the following organic compound:

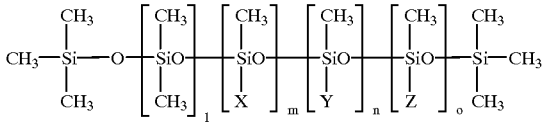

where X is an alkoxy silyl group, Y is an organic functional group, and Z is an organic unit, and each of l, m, n and o is an integer not less than zero and (c) a metal powder.

* * * * *